US010739072B2

(12) United States Patent
Violette et al.

(10) Patent No.: US 10,739,072 B2
(45) Date of Patent: Aug. 11, 2020

(54) THROUGH AIR DRYING AND BONDING SYSTEMS AND METHODS FOR MAINTAINING UNIFORM SUPPLY AIR TEMPERATURE

(71) Applicant: Valmet, Inc., Biddeford, ME (US)

(72) Inventors: Lynn C. Violette, Scarborough, ME (US); Laurent R. Parent, Westbrook, ME (US); Rick A. Fortier, Westbrook, ME (US)

(73) Assignee: Valmet, Inc., Biddeford, ME (US)

( * ) Notice: Subject to any disclaimer, the term of this patent is extended or adjusted under 35 U.S.C. 154(b) by 25 days.

(21) Appl. No.: 16/259,119

(22) Filed: Jan. 28, 2019

(65) Prior Publication Data

US 2019/0368812 A1 Dec. 5, 2019

Related U.S. Application Data

(60) Provisional application No. 62/678,643, filed on May 31, 2018.

(51) Int. Cl.
*F26B 23/04* (2006.01)
*F26B 25/04* (2006.01)
(Continued)

(52) U.S. Cl.
CPC ..... *F26B 23/04* (2013.01); *F26B 3/02* (2013.01); *F26B 21/004* (2013.01); *F26B 21/10* (2013.01); *F26B 25/04* (2013.01)

(58) Field of Classification Search
CPC ..... F26B 3/04; F26B 3/02; F26B 3/00; F26B 21/00; F26B 21/004; F26B 21/10; F26B 25/00; F26B 25/04
(Continued)

(56) References Cited

U.S. PATENT DOCUMENTS 4,124,942 A 11/1978 Ohls et al.
4,268,974 A * 5/1981 Price ..... D21F 5/044 34/114
(Continued)

FOREIGN PATENT DOCUMENTS

CA 2575363 C * 1/2012 ..... D21F 5/182
EP 3034976 B1 * 1/2019 ..... D21F 5/18
(Continued)

*Primary Examiner* — Stephen M Gravini
(74) *Attorney, Agent, or Firm* — Pierce Atwood LLP; Kevin M. Farrell; Christopher A. Baxter

(57) ABSTRACT

Systems and methods for drying or bonding materials are described. A material to be dried or bonded may be passed through a through air dryer (TAD) or through air bonder (TAB). Some of the air output by the TAD/TAB may be recirculated to be passed back through material. As the air is recirculated, it is heated and mixed to a desired uniform temperature distribution. As heated air of the desired uniform temperature distribution is passed through ducting for transport to the material, the desired uniform temperature distribution deteriorates due to heat loss experienced at the walls of the ducting. Heating tape is implemented with respect to particular locations of ducting and selectively operated to maintain air traveling through the ducting at the desired uniform temperature distribution. Heat generated by the heating tape is used to counteract heat loss experienced by air traveling through the ducting.

20 Claims, 6 Drawing Sheets

(51) Int. Cl.
*F26B 21/00* (2006.01)
*F26B 21/10* (2006.01)
*F26B 3/02* (2006.01)

(58) Field of Classification Search
USPC ..... 34/241, 110–124
See application file for complete search history.

(56) References Cited

U.S. PATENT DOCUMENTS 4,501,072 A * 2/1985 Jacobi, Jr. ..... F26B 3/283 101/488
4,502,228 A * 3/1985 Helbig ..... F26B 21/06 118/68
5,255,447 A * 10/1993 Christ ..... D21F 5/044 34/114
5,383,288 A * 1/1995 Ilmarinen ..... D21F 5/00 34/119
5,575,252 A * 11/1996 Bauer ..... F02B 67/00 123/196 R
5,657,636 A 8/1997 Suggs
6,024,905 A * 2/2000 Doris ..... B27N 3/10 264/121
6,668,590 B2 * 12/2003 Lewandowski ..... C03B 29/08 65/111
6,964,117 B2 * 11/2005 Parent ..... F26B 13/16 34/528
7,089,682 B2 * 8/2006 Sundqvist ..... D21F 5/044 34/117
7,225,558 B2 * 6/2007 Hagen ..... D21F 5/182 34/124
8,196,314 B2 * 6/2012 Munch ..... D21F 5/20 34/618
8,597,555 B2 * 12/2013 Pedoja ..... D04H 1/4382 264/103
8,869,420 B1 * 10/2014 Nazhad ..... F26B 21/08 110/342
9,765,480 B2 * 9/2017 Schmit ..... D21F 5/18
10,113,268 B2 * 10/2018 Schmit ..... D21F 5/18
10,533,283 B2 * 1/2020 Parker ..... D21F 5/02
2004/0118009 A1 6/2004 Parent
2005/0085178 A1 4/2005 Hall
2006/0021249 A1 2/2006 Hagen et al.
2016/0177508 A1 6/2016 Schmit et al.
2019/0368812 A1 * 12/2019 Violette ..... F26B 21/004

FOREIGN PATENT DOCUMENTS

EP 3543023 A1 * 9/2019 ..... B41J 15/04
FR 3030705 A1 * 6/2016 ..... D21F 5/18
JP 2019166666 A * 10/2019 ..... B41F 23/0426
WO WO-03035562 A1 * 5/2003 ..... F27B 9/3005
WO WO-2006020300 A3 * 2/2007 ..... D21F 5/182
WO WO-2008052624 A8 * 7/2008 ..... D04H 3/011

* cited by examiner

THROUGH AIR DRYING AND BONDING SYSTEMS AND METHODS FOR MAINTAINING UNIFORM SUPPLY AIR TEMPERATURE

BACKGROUND

"Through air technology" is a term used to describe systems and methods enabling the flow of heated air through a nonwoven web for the purpose of drying or bonding fibers or filaments. Examples include the drying of nonwoven products (e.g., tea bags and specialty papers); drying and curing of fiberglass mat, filter paper, and resin-treated nonwovens; thermobonding and drying of spunbond nonwovens; drying hydroentangled webs; thermobonding geotextiles with or without bicomponent fibers; drying and curing interlining grades; and thermobonding absorbent cores with fusible binder fibers. The drying of tissue paper is also a particularly important application of through air technology. Systems and methods related to through air drying are commonly referred to through the use of the "TAD" acronym.

SUMMARY

The present disclosure is applicable to the genus of through air technology systems (including dryers and bonders) and methods. As used herein, "TAD" may refer to "through air drying" or "through air dryer" depending on the context in which it is used. As used herein, "TAB" may refer to "through air bonding" or "through air bonder" depending on the context in which it is used.

A significant challenge relating to TAD/TAB systems is the introduction of large quantities of energy (e.g., 1 to 60 MW) into a TAD/TAB system without compromising performance, controllability, and reliability, enlargement of the TAD/TAB system, pressure drop, air mixing, turndown, and achieving target air temperature to a TAD/TAB from heat exchange devices.

For through air technology systems, the air temperature that passes through the material to be dried or bonded may need to be uniform, sometimes with less than about +/−1° C. variation. This level of temperature uniformity may be required to achieve uniform bonding or drying at the material's edges and across the full width of the material to meet process or product quality requirements.

The width of the material to be dried may be greater than 6 meters at times. Uniformity can be difficult to achieve over such a span. Even with uniform heating, good mixing, and insulated ducting, there is often cooler air in a boundary layer(s) of the air due to heat loss experienced while the air passes through ducting.

The present disclosure provides techniques for heating one or more boundary layers of air in ducting to keep the boundary layer(s) at or near a desired temperature for drying or bonding material. The present disclosure also provides techniques for heating some area of the boundary layer(s) more than others to overcome heat losses in the system.

Electrical heating tape(s) may be placed proximate to or coupled to an outside of a duct wall inside skin. The heating tape(s) may cover about 50% to about 100% of some of the duct walls depending on output (watts/in$^2$) of one or more heating elements used by the system. The heating tape(s) may be implemented based on locations of anticipated heat losses and the system's duct arrangement.

An aspect of the present disclosure relates to a system including a fan, an air heater, a mixing element, ducting, and a hood. The air heater heats air received from the fan to produce first heated air. A mixing element operates on the first heated air to generate second heated air of a desired uniform temperature distribution. Ducting, coupled to the mixing element, includes at least one heating tape located proximate to two parallel walls of the ducting. The at least one heating tape is selectively operated to compensate for heat loss experienced by the second heated air while traveling through the ducting. A hood, including an air inlet, couples to the ducting at the air inlet. The hood surrounds a foraminous cylinder. The foraminous cylinder provides an air outlet that is in fluidic communication with the fan.

Another aspect of the present disclosure relates to a method including outputting unheated air from a fan. The unheated air is manipulated to produce heated air having a desired uniform temperature distribution. The heated air is sent, through ducting, to an air inlet of a hood. At least one heating tape, located proximate to two parallel walls of the ducting, is used to compensate for heat loss experienced by the heated air while traveling through the ducting. The heated air is communicated to a material on a foraminous cylinder in the hood. The heated air becomes unheated air as it dries or bonds the material. This unheated air is then circulated to the fan.

A further aspect of the present disclosure relates to a system including ducting, a hood, and a foraminous cylinder. The ducting receives heated air. The ducting has at least one heating tape located proximate to two opposing walls of the ducting. The at least one heating tape is selectively operated to compensate for heat loss experienced by the heated air while traveling through the ducting. The hood receives the heated air from the ducting. The hood at least partially surrounds the foraminous cylinder. The foraminous cylinder moves material through the hood, with the material being contacted by the heated air.

While the present disclosure is described with respect to through air systems including dryers and bonders, other systems may be used, such as Yankee air systems, flatbed dryers, floater dryers, and other dryers and ovens.

BRIEF DESCRIPTION OF DRAWINGS

For a more complete understanding of the present disclosure, reference is now made to the following description taken in conjunction with the accompanying drawings.

DETAILED DESCRIPTION

Certain systems include a TAD/TAB having a hood and foraminous cylinder that are wider than a width of the material being dried or bonded. Such a configuration allows for cooler air, in the boundary layer(s) of heated air, to mostly bypass the edge of the material. This results in a substantial amount of the system's energy being wasted. Certain systems may also or alternatively include ducting specially designed to minimize a heat transfer path, which minimizes the decrease in temperature of the boundary layer.

Certain systems add bypass air into the airflow. Adding bypass air adds to the width of the TAD/TAB. Such may be unbeneficial because it requires increased space, capital cost, and energy consumption. Systems adding bypass air into the airflow have been used by Valmet, Inc. for more than two decades.

The present disclosure improves upon such systems by using heating tape(s) to ensure the boundary layer(s) of air input to a TAD/TAB is at a desired temperature for drying or bonding material. Heating tape(s) is placed at particular locations of ducting and selectively operated (e.g. activated) to maintain air traveling through the ducting at a desired uniform temperature distribution. Heat generated by the heating tape(s) may be used to counteract heat loss experienced by air traveling through the ducting.

Figure 1:
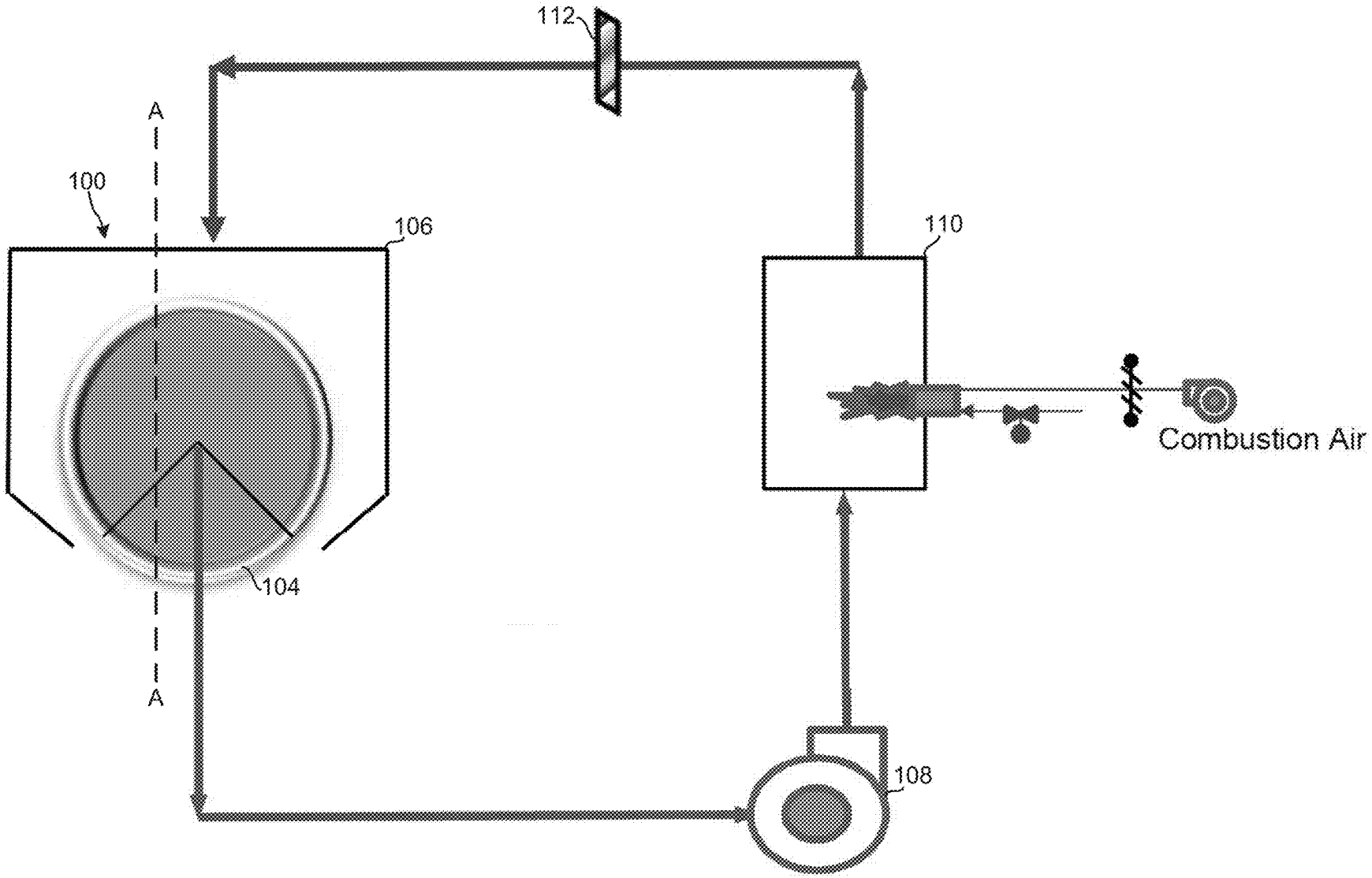
FIG. 1 is a schematic diagram of a single TAD/TAB system according to embodiments of the present disclosure.

FIG. 1 illustrates an example configuration of a single TAD/TAB system. The lines between components illustrated in FIG. 1 represent possible ducting and airflow.

The TAD/TAB system may include a TAD/TAB 100 including a foraminous (e.g., porous) cylinder 104 at least partially surrounded by a hood 106, a main fan(s) 108, an air heater(s) 110, and a mixer(s) 112. A width of the hood 106 may be commensurate with a width of material, to be dried or bonded, moved along the foraminous cylinder 104. While only one main fan 108, one air heater 110, and one mixer 112 are illustrated, one skilled in the art will appreciate that the TAD/TAB system may include more than one main fan 108, more than one air heater 110, and/or more than one mixer 112.

Material to be dried or bonded is carried along the foraminous cylinder 104 through the hood 106. Heated air of a desired uniform temperature distribution is input to the hood 106 and exposed to the material to be dried or bonded. Air is cooler after it travels through the material than it was when it first contacted the material. The cooled air travels through holes in the foraminous cylinder 104 and is output from the TAD/TAB 100 as cooled (or exhaust) air.

At least some of the cooled air output from the TAD/TAB 100 may be recirculated to the TAD/TAB 100. As illustrated, cooled air that is output from the TAD/TAB 100 may be passed through the main fan 108 to the air heater 110. The air heater 110 may heat the cooled air via combustion of fossil fuels. The air heater 110 heats the cooled air and outputs the heated air to the mixer 112. The air heater 110 may include various types of air heating elements known in the art and not yet created. For example, the air heater 110 may include one or more electric heaters, one or more steam coils, one or more glycol/air heat exchangers, and/or one or more combustion-based heating elements. The air heating element(s) implemented in the air heater 110 may depend on system configuration and a desired temperature of the air to be output by the air heater 110.

The mixer 112 receives heated air from the air heater 110 and outputs heated air of a desired uniform temperature distribution. The heated air of the desired uniform temperature distribution is input to the TAD/TAB 100 (and more particularly to the hood 106).

While not illustrated, one skilled in the art will appreciate that the system may include an exhaust whereby at least some air in the airflow is removed from the system. The exhaust may be located between the main fan 108 and the heater 110 in an example configuration.

While FIG. 1 illustrates a particular arrangement of components of the system, other arrangements may be possible. For example, while FIG. 1 illustrates the heater 110 as being upstream from the main fan 108 with respect to airflow, one skilled in the art will appreciate that the main fan 108 may be upstream from the heater 110 with respect to airflow. Other component arrangements are also possible.

Figure 2:
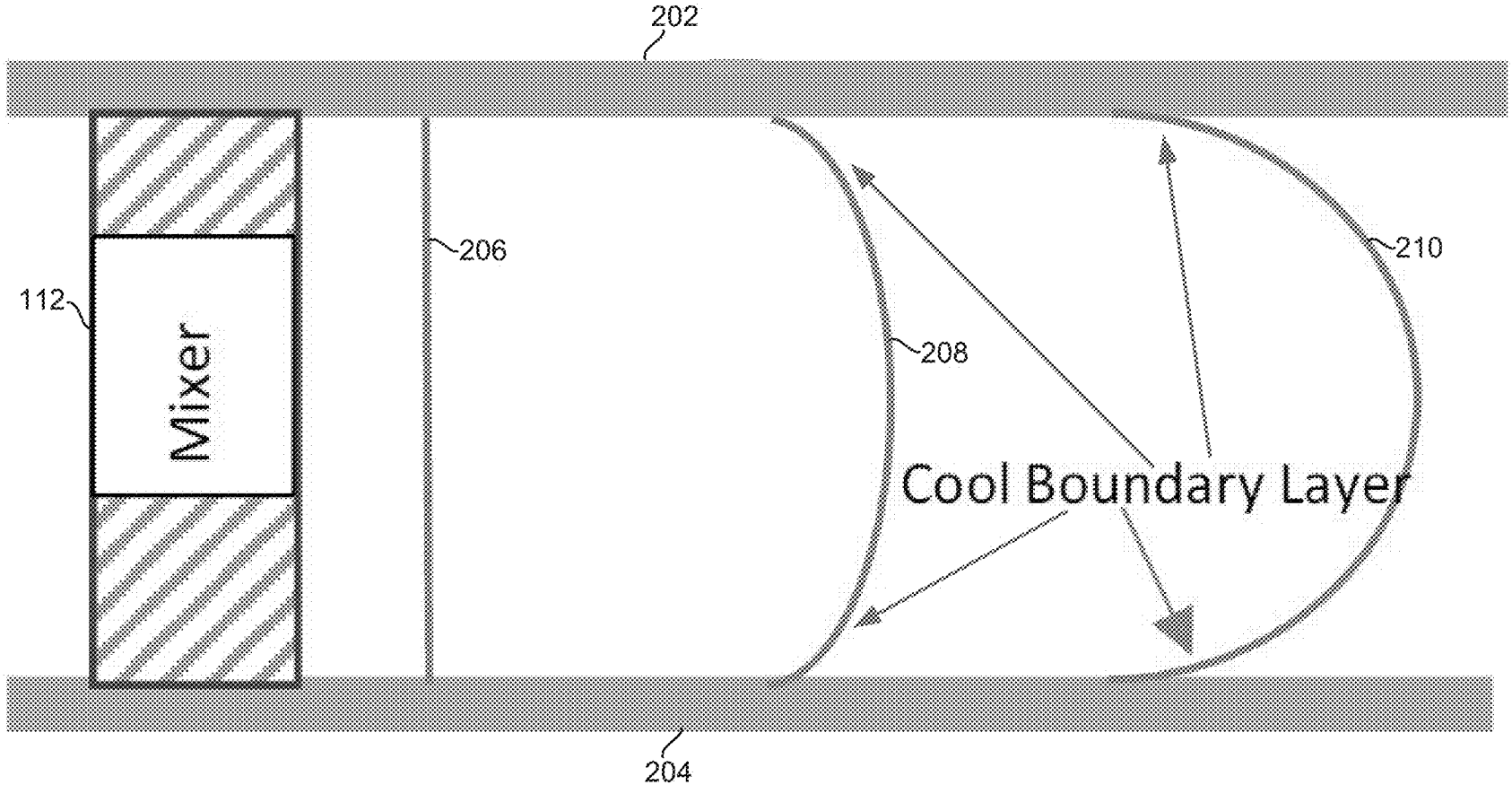
FIG. 2 is a conceptual diagram of how a boundary layer(s) of air decreases in temperature as the air travels through ducting according to embodiments of the present disclosure.

The lines between components of the TAD/TAB system, illustrated in FIG. 1, represent airflow caused by ducting that couples the components together. FIG. 2 illustrates how a boundary layer(s) of air decreases in temperature as the air travels through ducting. While FIG. 2 illustrates ducting located downstream from the mixer 112 with respect to air flow, one skilled in the art will appreciate that the change in the boundary layer(s) of air illustrated in FIG. 2 may be experienced in ducting located at other locations in the system.

Ducting may include walls (202/204). When air is output from the mixer 112, the air may exhibit a perfect (or nearly perfect) desired uniform temperature distribution (illustrated by the linear temperature profile 206). As the air travels through the ducting, the desired uniform temperature distribution deteriorates. That is, the boundary layer(s) decreases in temperature as the air travels through the ducting (i.e., more and more of the air located at or proximate the ducting walls 202/204 decreases in temperature as the air travels through the ducting). This is illustrated by a comparison of temperature profiles 206, 208, and 210. The boundary layer (s) may grow due to man doors, flanges, or other locations in the ducting walls (202/204) whereby heat loss is capable of occurring. As a result, the air goes from having a desired uniform temperature distribution (as illustrated by the linear temperature profile 206) to a distribution including a desired temperature for drying or bonding material at a location away from the ducting walls (202/204), and a cooled temperature at the boundary layer(s) (as illustrated by the arcuate temperature profiles 208 and 210 in FIG. 2).

By using heating tape(s) on one or more walls of the ducting, the boundary layer(s) of the air may be maintained (or substantially maintained) at a desired temperature for drying or bonding material during the entirety of the air's travel through the ducting. This would result in the air maintaining the linear temperature profile 206 while traveling through the ducting.

Figure 3A:
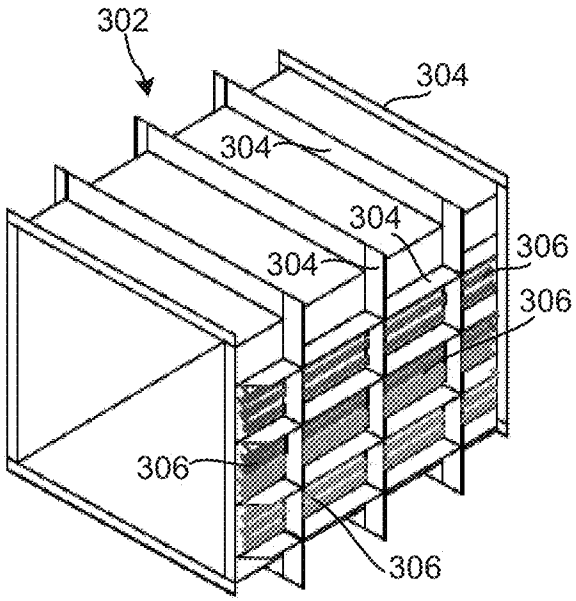
FIG. 3A is a perspective view of an inside skin of ducting including heating tape(s) according to embodiments of the present disclosure.
Figure 3B:
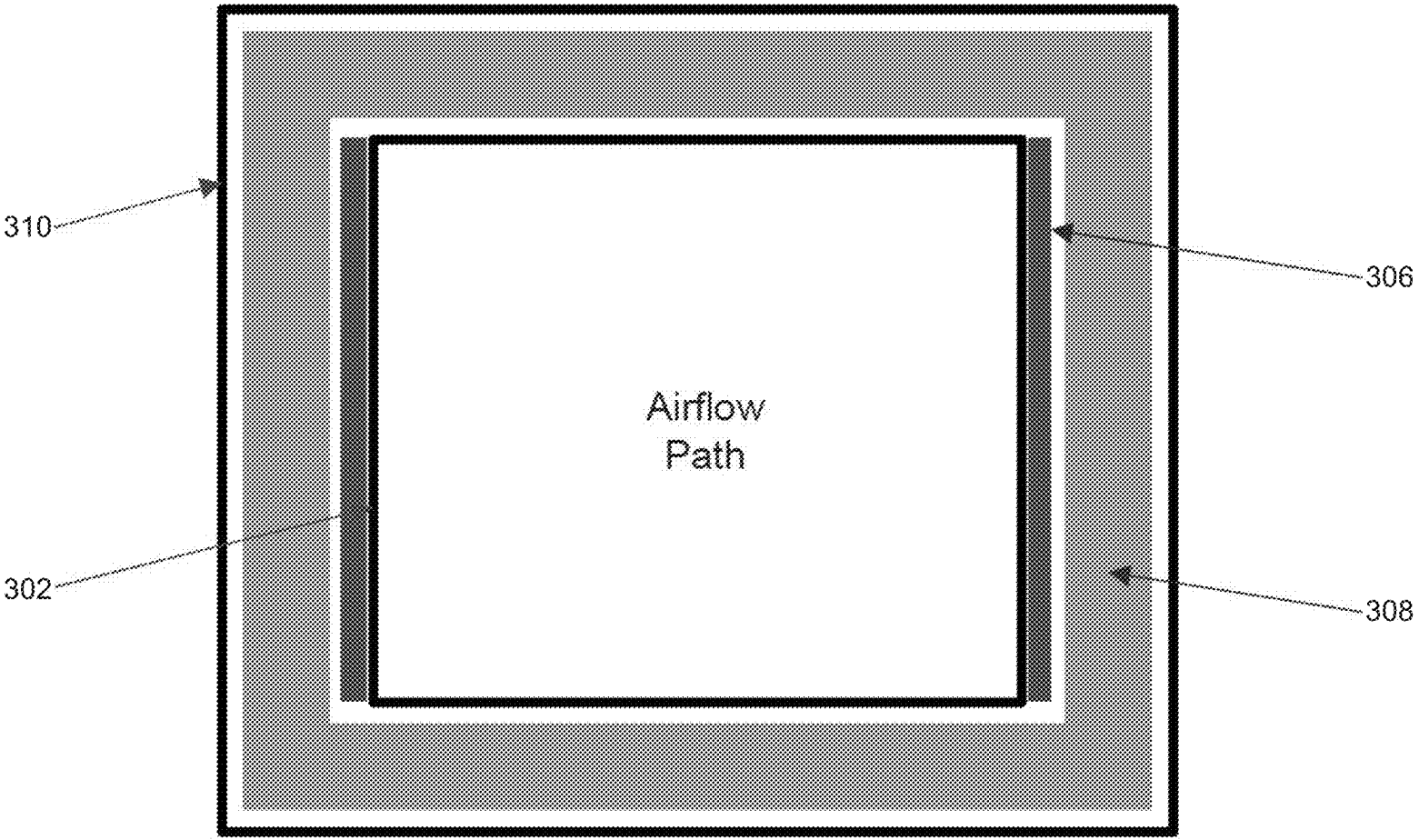
FIG. 3B is a cross-sectional view of ducting taken along a plane perpendicular to airflow according to embodiments of the present disclosure.

FIGS. 3A and 3B illustrate ducting including heating tape. Depending on the system, the ducting may by 1 m×1 m, 3 m×3 m, or some other size.

Ducting includes an inside skin 302 and an outside skin 310. An insulation layer 308 may be located between the inside skin 302 and the outside skin 310. For example, the insulation layer 308 may be located between protrusions 304 extending from the surface of the inside skin 302.

Heating tape(s) 304 may be placed proximate to or coupled to at least one outer surface of the inside skin 302 of the ducting. In an example, the heating tape(s) 304 is located between an outer surface of the inside skin 302 and the insulation layer 308.

Multiple strips of heating tape 304 may be placed proximate to or coupled to the inside skin 302. The strips of heating tape 304 may be controlled as a single unit (e.g., may be selectively operated as a single unit) or a subset of the heating tape 304 may be selectively operated separate from other strips of the heating tape 304.

The heating tape(s) 304 may be placed proximate to or coupled to the inside skin 302 of ducting located between the mixer 112 and the TAD/TAB 100 (and more particularly an air inlet of the hood 106). If the system includes more than one mixer 112, the heating tape(s) 304 may be placed proximate to or coupled to the inside skin 302 of ducting located after the last mixer 112 with respect to airflow (e.g., placed proximate to or coupled to the inside skin 302 of ducting located between the last mixer 112 and the TAD/TAB 100). However, one skilled in the art will appreciate that the heating tape(s) 304 may be implemented with other ducting of the system.

The heating tape(s) 304 may be implemented along an entire distance (or implemented along a substantial distance) of the ducting between the mixer 112 and the TAD/TAB 100. Alternatively, the heating tape(s) 304 may only be placed proximate to or coupled to the ducting proximate to an air inlet of the hood 106.

The amount of heating tape(s) 304 placed proximate to or coupled to a particular section of ducting (e.g., implemented along a particular length of the ducting) may depend on energy cost and/or a strategy for controlling the temperature of the boundary layer(s). For example, heating tape(s) 304 may be uniformly implemented along all or nearly all of the length of the ducting from the mixer 112 to the TAD/TAB 100. In this implementation, the heating tape(s) 304 may maintain the boundary layer(s) at or substantially at a desired drying or bonding temperature over the duration of the ducting (e.g., the heating tape(s) 304 may be operated to maintain a desired uniform temperature distribution along the duration of the ducting). In another example, heating tape(s) 304 may only be placed proximate to or coupled to ducting proximate to the air inlet of the hood 106, or a thicker amount of heating tape(s) 304 may be placed proximate to or coupled to ducting proximate to the air inlet of the hood 106 than is implemented distant from the air inlet of the hood 106. In this implementation, the heating tape(s) 304 may gradually increase the temperature of the boundary layer(s) of the air as the air gets closer to the air inlet of the hood 106 such that the air experiences a desired uniform temperature distribution by the time the air reaches the air inlet of the hood 106. Better control of the boundary layer(s) may be experienced by implementing heating tape(s) 304 over the length of the ducting, as compared to simply implementing heating tape(s) 304 to ducting proximate to the air inlet of the hood 106. In some systems, implementing heating tape(s) 304 over the entire length of the ducting between the last mixer 112 and the air inlet of the hood 106 may be beneficial because heat loss may be relatively constant along the length of the ducting. The cost of operating the heating tape(s) 304 may be a minimal consideration because the difference between the temperature of the boundary layer(s) and the desired temperature for drying or bonding material may only be a few degrees (e.g., +/−2° C.).

As illustrated in FIGS. 3A and 3B, the inside skin 302 may include four walls or surfaces that contact air traveling through the inside skin 302. As such, one skilled in the art will appreciate that the temperature profile of the air may be conical. That is, the boundary layers at or proximate each of the four walls of the inside skin 302 may have decreased temperature as compared to air located distant from the walls of the ducting.

Heating tape(s) 306 may be placed proximate to or coupled to the outside surface of each of the four walls of the inside skin 302. Such implementation may result in the temperature profile of the air being completely planar (as illustrated by 206 in FIG. 2).

Figure 4:
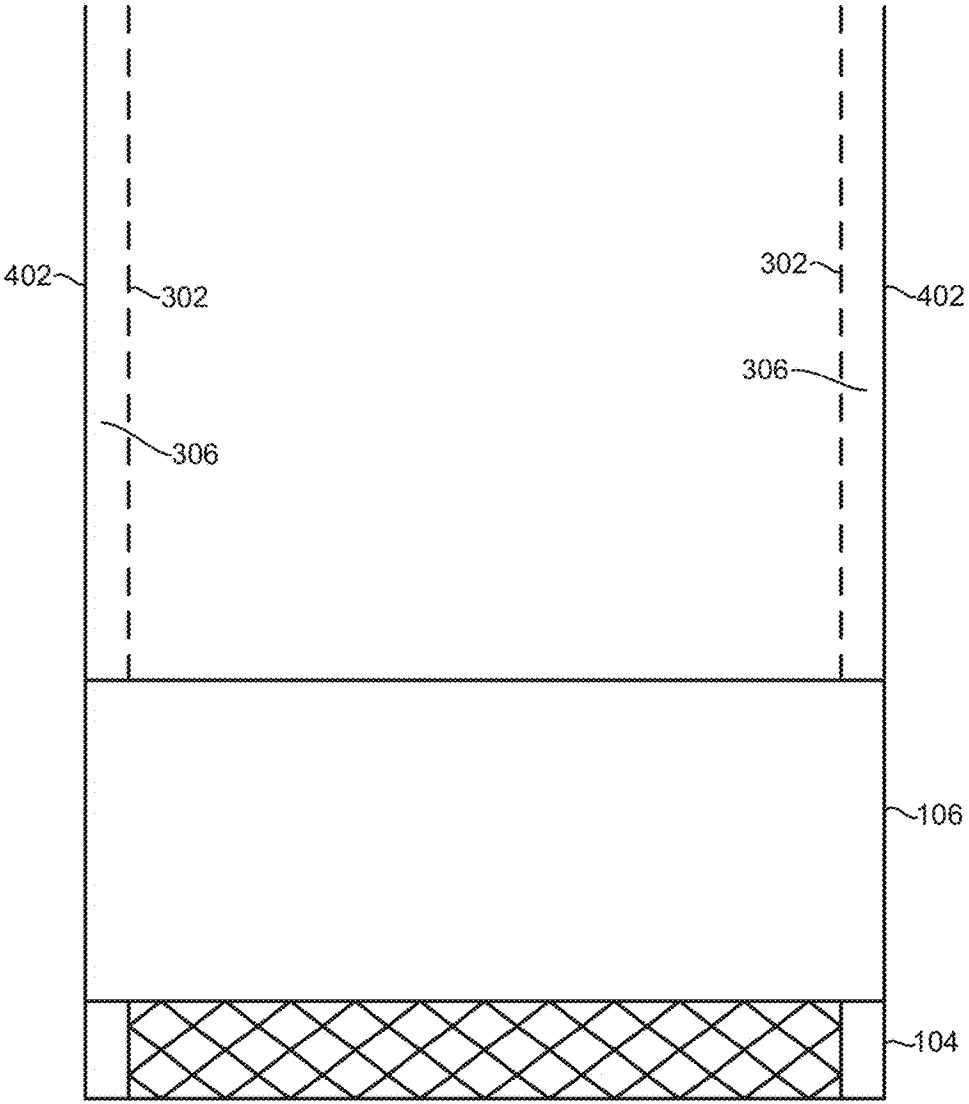
FIG. 4 is a side view of a TAD/TAB and ducting taken along line A-A in FIG. 1 according to embodiments of the present disclosure.

In at least some systems, it may not be necessary to implement heating tape(s) 306 with respect to every wall of the inside skin 302. Two opposing (e.g., parallel) walls of the inside skin 302 may communicate with air that is ultimately exposed to edges of material to be dried or bonded on the foraminous cylinder 104 (as illustrated in FIG. 4). The other two opposing walls (that would extend along the plane of the paper on which FIG. 4 is illustrated) of the inside skin 302 may communicate with air that is ultimately exposed to non-edge portions of the material to be dried or bonded.

It may be beneficial to implement heating tape(s) 306 with respect to the walls of the inside skin 302 that communicate with the air that is exposed to the edges of the material to be dried or bonded, but may not be necessary to implement heating tape(s) 306 with respect to the walls of the inside skin 302 that communicate with air that is exposed to the non-edge portions of the material to be dried. By using heating tape(s) 306 to heat the air that communicates with the edges of the material to be dried or bonded, the temperature profile of the air in the ducting may be arcuate. The arcuate temperature profile of the air may include two boundary layers, of decreased temperature, that extend along the plane of the paper on which FIG. 4 is illustrated. In other words, the boundary layers would extend parallel with the material to be dried or bonded on the foraminous cylinder 104. As the foraminous cylinder 104 rotates, causing the material to be dried or bonded to pass through the hood 106, the entirety of the material (even the edges) would first be subject to a first boundary layer of decreased temperature, then subjected to the desired drying or bonding temperature, and then subjected to the second boundary layer of decreased temperature. Thus, it should be appreciated that the entirety of the material (even the edges) is subjected to the desired temperature for drying or bonding for a duration of time. Such may effectively dry or bond the material even though the material may also be subject to the decreased temperatures of the boundary layers.

Nonetheless, it may be beneficial to implement at least some heating tape(s) 306 with respect to the opposing walls of the inside skin 302 that do not communicate with air that contacts the edges of the material. Such heating tape(s) may be used to control the size of the decreased temperature boundary layers of the arcuate temperature profile and, as a result, change the amount of decreased temperature air and desired temperature air applied to the material to be dried or bonded.

Figure 5:
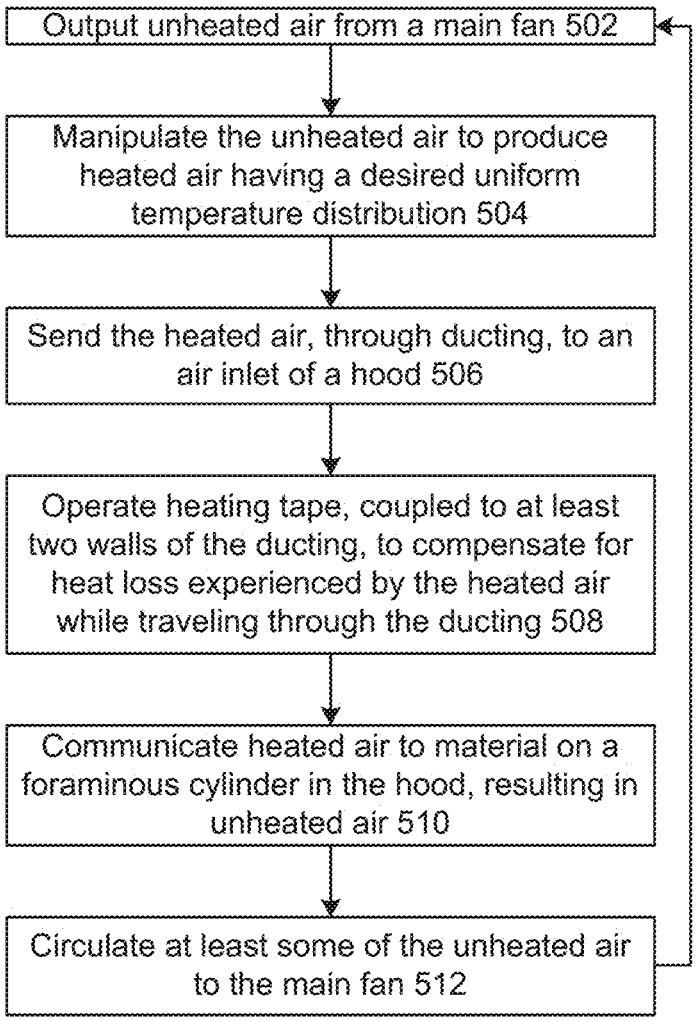
FIG. 5 is a process flow diagram illustrating the use of heating tape(s) to maintain a boundary layer(s) of air at or about a desired temperature for drying or bonding material while traveling through ducting according to embodiments of the present disclosure.

FIG. 5 illustrates the use of heating tape(s) 306 to maintain a boundary layer(s) of air at or about a desired temperature for drying or bonding material while traveling through ducting. Unheated air is output (502) from the main fan 108. The unheated air is manipulated (504) to produce heated air having a desired uniform temperature distribution. The unheated air may be manipulated by passing the unheated air through at least one heater 110 and at least one mixer 112. The heated air having the desired uniform temperature distribution is sent (506), through ducting, to an air inlet of the hood 106.

Heating tape(s) 306, coupled to at least two walls of the ducting, is operated (508) to compensate for heat loss experienced by the heated air while traveling through the ducting. The heating tape(s) 306 may be operated using at least one temperature sensor and a control loop. The at least one temperature sensor may be used to monitor the temperature of the heated air at or proximate at least one wall of the ducting.

Heating tapes of different outputs may be used. As such, one skilled in the art will appreciate that the amount of heating tape(s) 306 used may depend on the output of the heating tape(s) 306, the amount of insulation in the ducting, material make-up of the ducting, etc. For example, heating tape(s) 306 capable of producing stronger outputs may only need to cover about 50% of an area of ducting wall between the mixer 112 and the TAD/TAB 100, whereas heating tape(s) 306 capable of producing lesser outputs may need to cover more than about 50% (e.g., up to about 100%) of the area of the ducting to affect the boundary layer of the air in the same manner. One skilled in the art will also appreciate that the amount of output of heating tape(s) 306 need to maintain the boundary layer(s) at the desired temperature for drying or bonding may depend on the temperature of the air output by the mixer 112, the amount of insulation in the ducting, the material make-up of the ducting, etc.

The heated air, after passing through the ducting, is communicated (510) to material on the foraminous cylinder 104 in the hood 106. The heated air becomes unheated air after it passes through the material. At least some of this unheated air is circulated (512) to the main fan 108. This results in an airflow loop as illustrated in FIG. 1.

While the present disclosure has been particularly described in conjunction with specific embodiments, it is evident that many alternatives, modifications, and variations will be apparent to those skilled in the art in light of the foregoing description. It is therefore contemplated that the appended claims will embrace any such alternatives, modifications, and variations as falling within the true spirit and scope of the present disclosure.

What is claimed is:

1. A system, comprising:

a fan;

an air heater in fluidic communication with the fan, the air heater heating air received from the fan to produce first heated air;

a mixing element in fluidic communication with the air heater, the mixing element operating on the first heated air to generate second heated air of a desired uniform temperature distribution;

ducting coupled to the mixing element, the ducting having at least one heating tape located proximate to two parallel walls of the ducting, the heating tape being selectively operated to compensate for heat loss experienced by the second heated air while traveling through the ducting;

a hood including an air inlet, the hood coupling to the ducting at the air inlet; and a foraminous cylinder surrounded by the hood, the foraminous cylinder providing an air outlet, the air outlet being in fluidic communication with the fan.

2. The system of claim 1, wherein the ducting comprises:

an inside skin;

an outside skin; and insulation located between the inside skin and the outside skin, wherein the at least one heating tape is located between the inside skin and the insulation.

3. The system of claim 1, wherein the at least one heating tape is located from a first location where the ducting couples to the mixing element to a second location where the ducting couples to the hood.

4. The system of claim 3, wherein the at least one heating tape is operated along a distance of the ducting from the first location to the second location to compensate for heat loss experienced by the second heated air over the distance.

5. The system of claim 1, wherein the at least one heating tape is operated proximate to the hood to compensate for heat loss experienced by the second heated air over a distance of the ducting.

6. The system of claim 1, wherein the two parallel walls of the ducting are in fluidic communication with outer edges of material moved along the foraminous cylinder.

7. The system of claim 1, wherein the hood has a width commensurate with a width of material moved along the foraminous cylinder.

8. The system of claim 1, wherein the at least one heating tape is selectively operated to heat boundary layers of the second heated air to a temperature experienced by a portion of the second heated air located away from surfaces of the ducting.

9. A method, comprising:

outputting first unheated air from a fan;

manipulating the first unheated air to produce heated air having a desired uniform temperature distribution;

sending, through ducting, the heated air to an air inlet of a hood;

using at least one heating tape, located proximate to two parallel walls of the ducting, to compensate for heat loss experienced by the heated air while traveling through the ducting;

communicating the heated air to a material on a foraminous cylinder within the hood, the heated air becoming second unheated air as it dries or bonds the material; and circulating the second unheated air to the fan.

10. The method of claim 9, further comprising:

positioning the at least one heating tape between an inside skin of the ducting and an insulation layer of the ducting.

11. The method of claim 9, further comprising:

positioning the at least one heating tape along a length of the ducting.

12. The method of claim 11, further comprising:

operating the at least one heating tape along the length of the ducting to compensate for heat loss experienced by the heated air over the length.

13. The method of claim 9, further comprising:

operating the at least one heating tape proximate to the hood to compensate for heat loss experienced by the second heated air over a length of the ducting.

14. The method of claim 9, further comprising:

configuring the two parallel walls of the ducting to be in fluidic communication with outer edges of the material moved along the foraminous cylinder.

15. The method of claim 9, further comprising:

configuring the hood to have a width commensurate with a width of the material moved along the foraminous cylinder.

16. The system of claim 9, wherein using the at least one heating tape comprises:

selectively operating the at least one heating tape to heat boundary layers of the heated air to a temperature experienced by a portion of the heated air located away from surfaces of the ducting.

17. A system, comprising:

ducting that receives heated air, the ducting having at least one heating tape located proximate to two opposing walls of the ducting, the at least one heating tape being selectively operated to compensate for heat loss experienced by the heated air while traveling through the ducting;

a hood configured to receive the heated air from the ducting; and a foraminous cylinder at least partially surrounded by the hood, the foraminous cylinder configured to move material through the hood, the material being contacted with the heated air.

18. The system of claim 17, wherein the at least one heating tape is located along a length of the ducting from a first location where the ducting receives the heated air to a second location where the ducting provides the heated air to the hood.

19. The system of claim 17, wherein the two opposing walls of the ducting are in fluidic communication with outer edges of the material moved along the foraminous cylinder.

20. The system of claim 17, wherein the at least one heating tape is selectively operated to heat boundary layers of the heated air to a temperature experienced by a portion of the heated air located away from walls of the ducting.

* * * * *